US008152943B2

(12) United States Patent
ten Cate et al.

(10) Patent No.: US 8,152,943 B2
(45) Date of Patent: Apr. 10, 2012

(54) METHOD FOR MANUFACTURING A WROUGHT METAL PLATE PRODUCT HAVING A GRADIENT IN ENGINEERING PROPERTIES

(75) Inventors: Andreas ten Cate, Amsterdam (NL); Sunil Khosla, Beverwijk (NL); Achim Büerger, Höehr-Grenzhausen (DE); Sabine Maria Spangel, Koblenz (DE)

(73) Assignee: Aleris Aluminum Koblenz GmbH, Koblenz (DE)

( * ) Notice: Subject to any disclaimer, the term of this patent is extended or adjusted under 35 U.S.C. 154(b) by 175 days.

(21) Appl. No.: 12/234,632

(22) Filed: Sep. 20, 2008

(65) Prior Publication Data

US 2009/0090437 A1 Apr. 9, 2009

Related U.S. Application Data

(60) Provisional application No. 60/979,758, filed on Oct. 12, 2007.

(30) Foreign Application Priority Data

Oct. 4, 2007 (EP) ..... 07 019 491

(51) Int. Cl.

| | |
|---|---|
| ***C21D 9/00*** | (2006.01) |
| ***C22F 1/04*** | (2006.01) |
| ***C21D 1/62*** | (2006.01) |

(52) U.S. Cl. ..... 148/559; 148/698; 266/259

(58) Field of Classification Search ..... 148/698, 148/559; 266/259
See application file for complete search history.

(56) References Cited

U.S. PATENT DOCUMENTS

| | | | |
|---|---|---|---|
| 4,609,035 | A | 9/1986 | Haslett et al. |
| 4,820,358 | A | 4/1989 | Chang |
| 5,547,524 | A | 8/1996 | Sainfort et al. |
| 2005/0217770 | A1 | 10/2005 | Lequeu et al. |
| 2007/0259200 | A1 | 11/2007 | Lequeu et al. |

FOREIGN PATENT DOCUMENTS

| | | | |
|---|---|---|---|
| EP | 0 284 876 | A1 | 10/1988 |
| JP | 2003213387 | A1 | 7/2003 |
| WO | 2005098072 | A2 | 10/2005 |
| WO | 2007/080265 | A1 | 7/2007 |

*Primary Examiner* — Jessee R. Roe
(74) *Attorney, Agent, or Firm* — Novak Druce + Quigg, LLP

(57) ABSTRACT

Manufacturing heat-treatable wrought metal plate having length, width and thickness directions and an engineering properties gradient along at least one plate dimension. Rolled, extruded or forged wrought metal plate is solution heat treated and rapidly cooled. The cooled plate is aged by heat treatment for time to arrive at different tempers across at least one plate dimension (length or width). Controlled heat-input into the plate along its length direction raises plate temperature above ambient temperature to temperature T1, and a temperature gradient is applied between temperature T2 and T3, wherein T2>T3, across at least one direction of the plate by controlled heat-input into the plate from one side (width or thickness) of the plate to temperature T2 and controlled cooling to temperature T3 from the plate at the opposite side of the controlled heat-input, and ageing the plate while applying the temperature gradient between T2 and T3.

20 Claims, 7 Drawing Sheets

METHOD FOR MANUFACTURING A WROUGHT METAL PLATE PRODUCT HAVING A GRADIENT IN ENGINEERING PROPERTIES

This claims the benefit of U.S. Provisional Patent Application No. 60/979,758, filed on Oct. 12, 2007, and European Patent Application No. 07 019 491.5 filed on Oct. 4, 2007, both incorporated herein by reference in their entirety.

FIELD OF THE INVENTION

The invention relates to a method for manufacturing a wrought metal plate product having a gradient in engineering properties, as well as to an apparatus for a graded heat treatment of a wrought metal plate product. The invention has particular application in the manufacture of rolled thin plate and plate applications for amongst others tooling, armour plate, and more in particular also for aerospace structural components such as wing boxes.

DESCRIPTION OF THE RELATED ARTS

As will be appreciated herein below, except as otherwise indicated, aluminum alloy designations and temper designations refer to the Aluminum Association designations in Aluminum Standards and Data and the Registration Records, as published by the Aluminum Association in 2007.

Aerospace structures such as wing boxes are constructed of many different parts, for which different properties are required. The upper wing skin for example requires higher compressive strength values than the lower wing skin, and is therefore generally manufactured from a different aluminum alloy. For the spar members connecting upper and lower wing skin, an aluminum alloy of intermediate properties between upper and lower wing skin is often selected. For example, some commercial aircraft use an AA7150 alloy for the upper wing skin, an AA2024 alloy for the lower wing skin, and an AA7050 for the front spar member. This means, however, that the difference in mechanical properties between the front spar and the lower wing skin to which it is attached is considerable.

Hence, manufacturers have been striving to produce parts having graded properties over their length or width. For example, an adequate solution for the above problem would be one where the top and the bottom sections of the spars and ribs had substantially identical properties to the upper and lower wing skins.

Another problem faced by aircraft manufacturers is the requirement of graded properties with respect to the length of the wing, i.e. from the wing root to the wing tip. At the wing root, the required properties are fatigue and damage tolerance, whereas static strength is required at the wing tip. Again, this problem could be solved in part or in whole by providing structural elements made of an aluminum alloy having graded properties and variable properties, respectively, along the length or width.

As explained in the ASM Specialty Handbook, Aluminum and Aluminum Alloys, ASM International, p. 5 (1993), heat treatable aluminum alloys are those alloys which respond to thermal treatment based on phase solubilities. These treatments include solution heat treatment, quenching, and precipitation, or age, hardening. For either cast or wrought alloys, such alloys are described as heat treatable. Heat-treatable alloys are those that can be hardened (strengthened) by a controlled cycle of heating and cooling. Some alloys in the AA2xxx, AA6xxx, AA7xxx, and AA8xxx series, are solution heat treatable such that they can be strengthened by heating and then quenching, or rapid cooling. They may be further strengthened by cold working-controlled deformation at room temperature.

In contrast, a large number of other wrought compositions rely instead on work hardening through mechanical reduction, typically in combination with various annealing procedures for property development. As explained in the ASM Specialty Handbook, Aluminum and Aluminum Alloys, ASM International, p. 5 (1993), these alloys are referred to as non-heat-treatable or work-hardening alloys. Some casting alloys are essentially not heat treatable and are used only in as-cast or in thermally modified conditions unrelated to solution or precipitation effects. Thus, non-heat-treatable aluminum alloys are hardenable by cold working, but not by heat treatment. The initial strength of these alloys, usually in the AA1xxx, AA3xxx, AA4xxx, and AA5xxx series, is provided by the hardening effect of their alloy elements. Additional strengthening can be created by cold working-deformation which induces strain-hardening denoted by the H-tempers.

The heat treating process for solution heat treatment includes the steps of (a) solutionizing heat treatment at a first temperature above the solvus temperature (for the particular alloy composition) and below the solidus and liquidus temperatures (for that alloy composition) and eutectic melting point (to avoid partial melting of the alloy) to dissolve the alloying constituent(s) in the aluminum and (b) a rapid cooling to a second temperature below the solvus to trap the constituent(s) in aluminum solid solution. In step (a), the alloy is maintained at the first temperature for a time sufficient to dissolve at least substantially, if not entirely, soluble constituents (such as intermetallic compounds) into solid solution and to form a homogeneous solid solution. Through solutionizing at least substantially all (e.g., at least about 80% and more typically at least about 95%) of the soluble second phase particles are dissolved into solid solution. When an alloy is in the form of a solid solution, the elements and compounds which form the alloy are absorbed, one into the other (or are homogeneous), in much the same way that salt is dissolved in a glass of water. The solution is then quenched to a lower temperature to create a supersaturated state or condition (for the form of the constituent in the quenched alloy). In other words, the form of the constituent in the alloy will have a concentration in the solid solution greater than the equilibrium value for the concentration of that form of the constituent at the particular temperature and alloy composition.

In precipitation heat treatment or ageing treatment, the alloy is heated to a third temperature higher than the second temperature and less than the solvus to control the rate that the constituent(s) diffuse out of solution and combine to form intermetallic precipitates. These precipitates distort the crystal lattice and act as obstacles to dislocation motion, thereby strengthening the material. Over time, these precipitates increase in size from (a) zones to (b) small clusters of aluminum and alloy component atoms to (c) fine coherent particles to (d) coarse incoherent particles.

US-2005/0217770-A1 describes a process for manufacturing aluminum alloy parts for wing skin members and stringers. It is disclosed that a variation of properties can be obtained by controlled heat treatment in a multi-zone aging furnace. This disclosed process provides for a furnace comprising at least three furnace zones with a unit length of at least about one meter. For example, to manufacture structural members with a length of about thirty-four meters, a furnace is used with a total length of thirty-six meters with thirty furnace zones with approximately equal lengths. Preferably, these furnace zones are adjustable independently of each other. Thereby, different tempers may be obtained over the length of the aluminum alloy part. However, in the disclosed example the aluminum alloy part is required to be aged twice.

U.S. Pat. No. 5,547,524 describes a process for manufacturing aluminum alloy plates with structural hardening having a continuous variation in properties in at least one direction, in which the final annealing is done in a furnace with a special structure comprising a hot chamber and a cold chamber connected by a heat pump. This process has been used to obtain small parts with a length of about one meter made of an AA7010 alloy, one end of which is in the T651 state, while the other end is in the T7451 state, wherein the process uses an iso-chronous annealing treatment. This process has never been developed industrially, since it is difficult to control compatibility with quality requirements necessary in the aeronautical construction field. These difficulties tend to increase even further as the size of the parts increases, knowing that the integration of two or more functions into one single structural member is especially interesting for very large pieces. Another problem that arises with this process is that the optimum durations of the T651 and T7451 treatments are different. Another problem that arises is that an AA7010 product in the T7451 state is typically obtained by an annealing treatment with two plateaus, whereas the T651 state is obtained by an annealing treatment with a single plateau.

SUMMARY OF THE INVENTION

It is an object of the present invention to provide a method of producing a heat-treatable or age-hardenable wrought metal plate product having a gradient in engineering properties along at least one dimension of the plate product.

It is a further object of the invention to provide an apparatus for the production of the above mentioned product with a gradient in engineering properties along at least one dimension, by applying a graded heat treatment along at least one dimension of the product. Moreover, there is provided a wrought metal product comprising one temper at one side, i.e. location, of the wrought metal product and another temper at the other side of the wrought metal product over at least one dimension of the product.

According to one aspect of the invention there is provided a method for manufacturing a heat-treatable wrought metal plate product having a length, width and thickness direction, preferably an aluminum alloy plate product, having a gradient in engineering properties along at least one dimension (length or width direction) of the plate product, comprising the steps of:

a) providing a wrought metal plate product selected from a rolled, extruded or forged product,
b) subjecting the plate product to a solution heat treatment, and
c) rapidly cooling the plate product, and
d) ageing of the cooled product comprising a heat treatment for time to arrive at different tempers across at least one dimension (length or width direction) of the plate product by applying a first controlled heat-input into the plate to raise the temperature of substantially the entire plate above ambient temperature to temperature T1 at or above ambient temperature (typically applying from the plate top wall 6 and/or bottom wall 5), and applying a temperature gradient between temperature T2 and T1, wherein T2>T1, across at least one direction of the plate (width or thickness direction) by applying a second controlled heat-input into the plate from one side (width or thickness) of the plate product to temperature T2 and a controlled cooling to temperature T3 from the plate product at the opposite side (width or thickness, 3, 4) of the second controlled heat-input, and at least partly ageing the product plate while maintaining the temperature gradient between T2 and T1 for a period of time. Preferably, this ageing step according to this invention is carried out in an apparatus that, for the duration of the ageing step, allows applying a controlled temperature profile over the plate product by applying simultaneously controlled heat input from at least a first side and a controlled cooling at a second side opposite to the first side with controlled heat-input.

Typically the present method provides a relatively lower level of heating along a first side, a relatively higher level of heating along another side and a cooling along a side opposite to the side having the relatively higher level of heating.

These and other objects and further advantages are met or exceeded by the present invention.

DETAILED DESCRIPTION OF THE INVENTION

Figure 1:
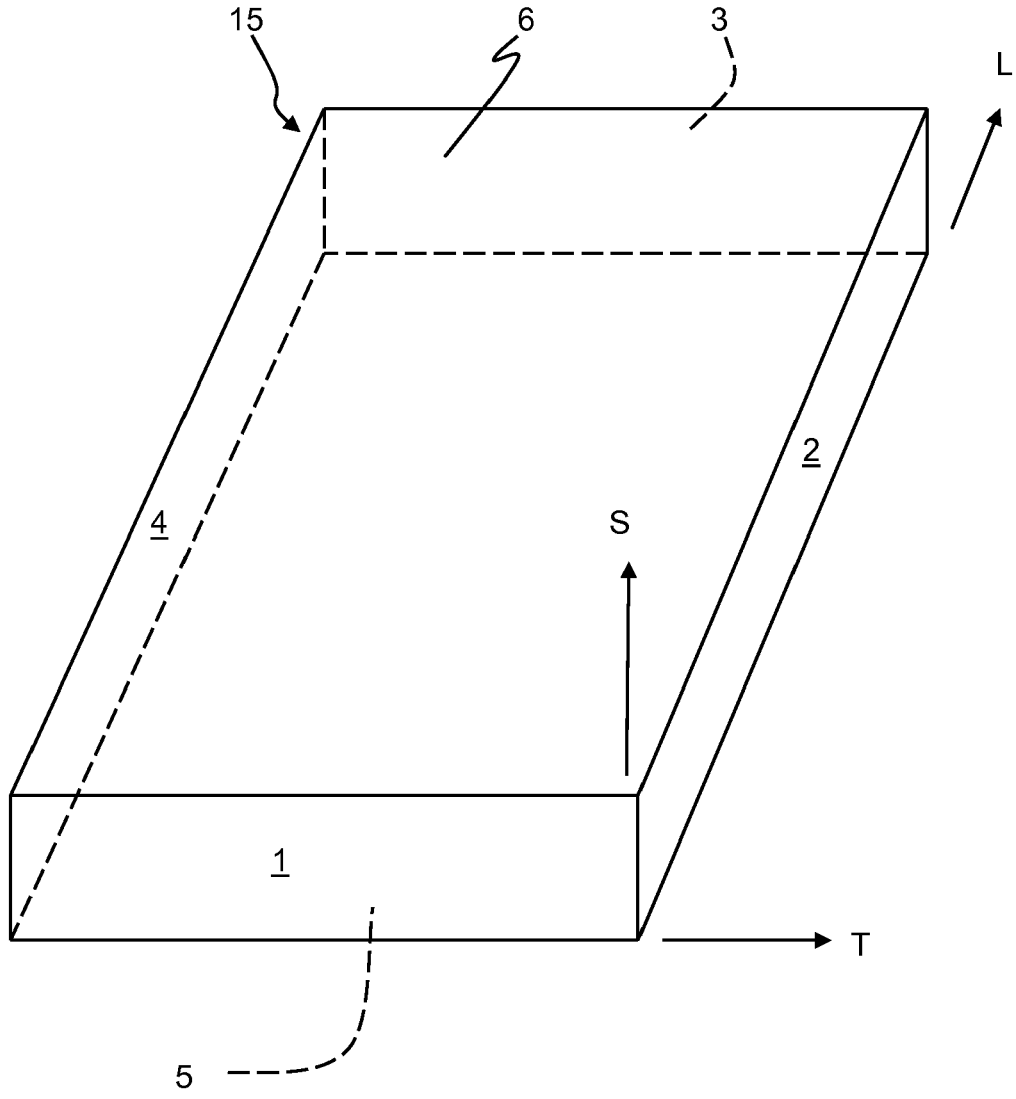
FIG. 1 is a perspective view of a plate product and pictorially represents the longitudinal (L), the transverse (T) and the short (S) directions of the plate product.

According to one aspect of the invention there is provided a method for manufacturing a heat-treatable wrought metal plate product having a length, width and thickness direction, preferably an aluminum alloy plate product, having a gradient in engineering properties along at least one dimension (length or width direction) of the plate product, comprising the steps of:

a) providing a wrought metal plate product selected from a rolled, extruded or forged product,
b) subjecting the plate product to a solution heat treatment, and
c) rapidly cooling the plate product, and d) ageing of the cooled product comprising a heat treatment for time to arrive at different tempers across at least one dimension (length or width direction) of the plate product by applying a first controlled heat-input into the plate to raise the temperature of substantially the entire plate above ambient temperature to temperature T1 at or above ambient temperature (typically applying from the plate top wall 6 and/or bottom wall 5), and applying a temperature gradient between temperature T2 and T1, wherein T2>T1, across at least one direction of the plate (width or thickness direction) by applying a second controlled heat-input into the plate from one side (width or thickness) of the plate product to temperature T2 and a controlled cooling to temperature T3 from the plate product at the opposite side (width or thickness, 3, 4) of the second controlled heat-input, and at least partly ageing the product plate while maintaining the temperature gradient between T2 and T1 for a period of time. Preferably, this ageing step according to this invention is carried out in an apparatus that, for the duration of the ageing step, allows applying a controlled temperature profile over the plate product by applying simultaneously controlled heat input from at least a first side and a controlled cooling at a second side opposite to the first side with controlled heat-input.

Typically T1 is at or above ambient temperature. Typically T3 is at or above ambient temperature. If desired T3 is less than or about equal to T1. If desired T1=T3. Having one side at ambient temperature results that this side will naturally age. However, in preferred embodiments all temperatures (T1, T2, T3) are higher than ambient resulting that the plate at these locations is artificially aged.

The engineering properties of the plate product may be physical or mechanical properties having a relevant role in the use of the final alloy plate product, for example mechanical properties, damage tolerance properties, or corrosion properties. It is considered to be known in the art that in a metal product produced on an industrial scale there is always some small and unintended variation in properties due to scale and/or to small compositional variations resulting from macro-segregation in a cast ingot which is subsequently rolled, extruded, and/or forged. However, the gradient in engineering properties achieved by the present invention is purposive and exceeds by far the minor fluctuations in properties due to macro-segregation and is being achieved over a substantial part of the plate product.

The method of the present invention may be used for the treatment of any heat-treatable wrought metal product, for example an aluminum alloy, magnesium alloy, copper alloy or steel, e.g., stainless steel. In a preferred embodiment an aluminum alloy is being used. The plate products manufactured used in the present invention can be rolled products (such as sheets, plates or thick plates) or extruded products (such as bars or sections) or forged products, or a combination of two thereof.

The invention is based on the insight that different temperatures, i.e. a temperature gradient, along at least one dimension of a plate product results in a different thermal history across this dimension of the plate product. Thereby, it is possible to produce different tempers or conditions at different product locations in the plate product resulting in a corresponding gradual or even linear change, i.e. a gradient, in engineering properties.

In the method of the present invention the plate product, e.g. an aluminum alloy plate, is firstly brought to a substantially uniform base temperature T1, wherein T1 is above ambient temperature. When manufacturing an aluminum plate product according to the present invention, the base temperature T1 ranges from about 50° C. to about 220° C., preferably from about 50° C. to about 200° C. This base temperature T1 is obtained by a heat input via a first side of the product, typically the rolling plane of the plate product in case of a rolled product. Thus, the heat input is into the thickness direction of the plate product. Thereafter, this heat input is maintained substantially constant during the heat treatment according to this invention. Moreover, an additional controlled heat-input is applied from at least a second side (width or length) of the plate product to raise the temperature at that location to a temperature T2. On the side opposite of the controlled heat-input a controlled cooling is applied to lower the temperature at that location to a temperature T3 near or at temperature T1, e.g. T1 may be within about 5 to 40° C., for example about 10° C. of T3). Then, due to thermal conductivity in the plate product, within a very short period of time a temperature gradient is obtained across at least one direction of the plate product. By controlling T2>T1 (and T2>T3) for a defined period of time t, the plate product achieves different tempers and consequently different corresponding engineering properties.

Controlled heat-up of the plate product can be achieved by using various heat sources regulated individually to a certain temperature or power, and disposed in the vicinity of the surface of the plate product. Typical heat sources include one or more of a heating plate, an induction heating device, arrays of induction coils, or arrays of gas burners or devices for distributing jets of hot fluid, electrical resistors, etc.

Controlled cooling of the plate product can be achieved using any devices or procedures suitable for industrial scale cooling of metal product. Thus, cooling may for example be accomplished by one or more of contact with a cooling plate, cooling fins, impinging jets or sprays with cooling fluid or any another heat-exchanging device that allows to apply controlled heat extraction from the plate product.

In an embodiment the aluminum alloy plate product is a rolled product, typically a thin plate or a plate. Ideally such a product has dimensions of a thickness of at least about 20 mm, for example about 80 mm or more, a typical width is in a range of about 200 mm to up to about 3.5 meters or even up to 4 meters, and the length is in practical terms limited to the dimensions of any industrial scale furnace, and could go from several meters up to about 40 meters or more.

According to a preferred embodiment of the present invention the heat input and heat extraction are applied to an aluminum alloy plate product to realize and maintain a base temperature T1 of the metal plate product at or above ambient, preferably in the range of about 35° C. to about 250° C., more typically in a range of about 80° C. to about 200° C., and a temperature difference (T2−T1 as well as T2−T3) in the range of about 20° C. to 150° C. from the one end to the other end of the plate product, wherein T2 is greater than T1 and T2 is greater than T3. The applied base temperature T1 and the temperature difference (T2−T1 as well as T2−T3) are aluminum alloy specific. A typical base temperature T1 would be in a range of about 120° C. to about 175° C. for AA7xxx-series alloys, and for AA2xxx-series. For Li-containing aluminum alloys a typical base temperature T1 would be in a range of about 150° C. to about 200° C. On top of this base temperature typical temperature differences (T2−T1) would be applied in a range of about 30° C. to about 50° C. for AA7xxx-series alloys, and as much as about 80° C., e.g., about 20° C. or 30° C. to about 80° C., for AA2xxx-series and Li-containing aluminum alloys. This temperature gradient can be realized over a relatively short distance, for example of about 0.5 to 1 meter. The established temperature profile is substantially continuous over any given dimension, and is typically approximately linear.

The method of the present invention may be used for the heat treatment of any heat treatable metal. For example, the method of the present invention may be used for the heat treatment of aluminum alloy products. In particular the present invention may be used for the heat treatment of products of the AA2xxx series, AA6xxx series, and AA7xxx series alloys, and Al—Li or Al—Cu—Li based aluminum alloys. Typical representative alloys from these aluminum alloy series are alloy within the compositional ranges of AA6013, AA6056, AA6011, AA6016, AA2024, A2524, AA2219, AA2026, AA2027, AA2090, AA7075, AA7040, AA7136, AA7050, AA7055, AA7081, AA7085, and modifications thereof.

Moreover, the aluminum product manufactured using the method of the present invention is a monolithic alloy product. Thus, the monolithic product has substantially one chemical composition within normal measurement and control accuracy. However, the product may also be formed by a combination of at least two or more alloys. Preferably the product is a mixture of at least two or more aluminum alloys, wherein this combination of two or more different aluminum alloys could be obtained from for example welding together two different plate products or a cast product obtained by the method as disclosed in international application WO-2007/080265, incorporated herein in its entirety by reference.

The heat treatment according to the invention is carried out to bring the plate product to its desired tempers. For aluminum alloy products the desired tempers would typically be an under-aged, peak aged or over-aged temper, such as T6, T7, and T8 tempers. A typical T7 temper of such a plate product would be a temper selected from the group comprising T73, T74, and T76, and would include the T7×51 and T7×52 variants.

In one embodiment of the present invention, an aluminum alloy plate product is manufactured with tempers that represent T73 or T74 at one plate location and T76 at the other end, wherein the alloy plate product with gradient properties will find application for rib members and for wing skin members.

The aluminum product manufactured with the present invention is preferably a structural component for aerospace application, and particularly a component selected from the group comprising an upper wing skin, lower wing skin, rib member, web member, wing panel, fuselage frame, wing rib, spar, stringer and stiffener.

In step c) of the method according to the present invention the plate product is rapidly cooled or quenched, preferably by one of spray quenching or immersion quenching in water or other quenching media.

In a further aspect of the present invention, it provides an apparatus for a graded heat treatment of a plate product, the apparatus comprising: i) a base and/or top support heating, and ii) one or more heat sources from at least one side of the plate product. Preferably, the apparatus further comprises: iii) one or more heat sinks from at least one side of the plate product.

In an embodiment, the apparatus of the present invention has a base support heating and/or a top support heating, one heat source from a first side wall and one heat sink from a second side wall, wherein these first and second side walls are preferably located on opposite sides of the wrought metal product. The plate product is heated from below or from above by the base or top support heating, for example by using a heating plate. It is also possible to heat the wrought metal product from the bottom and the top simultaneously. In the embodiment wherein the plate product is only heated from the base or from the top, the other side of the plate product is thermally insulated for example by means of a heat isolating fabric such as glass fabric, glass wool, mineral wool or polymeric fabric. Via a controlled heat input and heat supply, respectively, from the base/top support heating, on e.g. the bottom or the top of the plate product, a substantially constant temperature will be realized in the plate product. On top of the base temperature a thermal gradient will be realised by the above described controlled heat sources and heat sinks. Moreover, variation in arrangements of controlled heat sources and heat sinks allows an accurate control of a two-dimensional patterned heat treatment program over an entire plate product. Aluminum plate products can be produced that can be used ideally for example for manufacturing a rib of an aircraft or a wing skin member of an aircraft, and wherein the wing root is at another temper than the winglet and having corresponding differences in engineering properties.

Some preferred embodiments of the invention shall now be described with reference to the appended drawings.

FIG. 1 shows a plate product 15, e.g. an aluminum alloy plate, having four sidewalls (side planes) 1, 2, 3, 4, a bottom wall (bottom plane) 5 and a top wall (top plane) 6. Moreover, FIG. 1 shows the longitudinal L, the transverse T and the short S directions, i.e. the length, width and thickness of the plate product. The plate product as shown is substantially rectangular, but for carrying out the method of the invention it is also possible that one or more walls (1, 2, 3, 4) of the plate product have a curved shape. The bottom 5 and top 6 are ideally substantially flat.

In case the wrought metal product is a plate product 15, it is preferably heated either on a part, or on the entire surface, from one or both first walls 5, 6 into the S-direction, thus heat is applied from the rolling plane into the plate 15 in the thickness direction S, and it is heated either on a part, or on the entire surface from at least a second wall 1, 2, 3, 4 along the T-direction. Preferably, the plate product is simultaneously actively cooled from at least another side wall 1, 2, 3, 4 along the T-direction, which can be either entirely or partially on the opposite side of the heated surface in the T-direction. Accordingly, the heat input and heat extraction from both S- and T-directions, i.e. S- and T-side faces, of the plate product results in a temporal thermal gradient that is able to create a product with different tempers, having a gradual and preferably linear change in engineering properties.

For heating into the S-direction it is important to achieve a constant heat input from the at least first wall 5, 6, i.e. the S-side wall, of the wrought metal product 15 to realise a substantially constant base temperature T1 in the plate product, on top of which the thermal gradient is realised.

Figure 2:
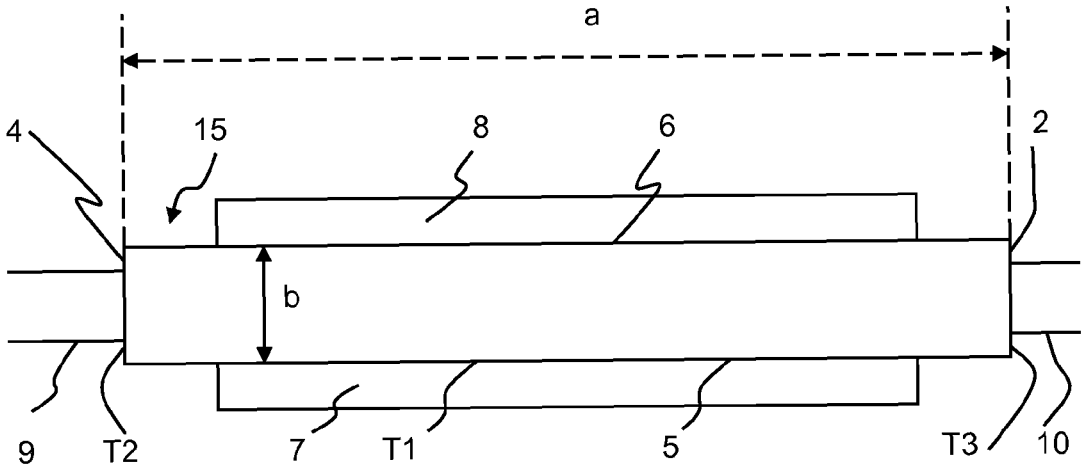
FIG. 2 is a schematic cross view of an apparatus that will allow a graded heat treatment of a plate product according to an embodiment of the invention.

In one arrangement the heat input can be either from a first wall 5 or from a first wall 6 while the opposite S-side face is thermally insulated with insulation 8 (see for example, FIG. 2).

In a second arrangement heating is applied on both first walls 5 and 6, i.e. into both S-side walls of the product.

As a third option, a combination of these two arrangements can be realised, where a series of plates are stacked on top of each other with the heat input from at least a first side 5, 6, i.e. a heating into the S-side wall, placed in between the plates and either support heating or thermal insulation on the outsides of a stack of plates. The arrangement of a stack of plates is preferred from an industrial point of view. An embodiment of this arrangement is described in more detail below regarding FIG. 7.

FIG. 2 shows an embodiment of the apparatus for a graded heat treatment of a plate product such as an aluminum alloy plate 15. This apparatus allows controlled heat input and temperature control from three walls 4, 2, 5 of the plate product 15. For example, the plate could have typical dimensions in thickness b (in S-direction), width a (in T-direction), and length (in L-direction) of about 80 mm×1 m×10 m. In the embodiment shown, the plate product is thermally insulated from above, i.e. from the top 6, by insulation 8. The heat input from the bottom wall 5 (into S-direction) of the aluminum alloy plate product 15 is carried out by a heating plate 7. The controlled heat input from one side wall 4 (into the T-direction) of the plate product 15 is carried out by, for example, an induction heating device 9. The opposite side wall 2 of the plate product 15 is cooled in a controlled manner via, for example, a cooling plate 10. Accordingly, it is possible to control the temperature at three walls 4, 2, 5 of the plate. The remaining side walls 1, 3 (FIG. 1) may be exposed or insulated (not shown).

Via a constant heat supply from the bottom wall 5 of the aluminum alloy plate 15, a constant temperature will be realized within the plate (assuming negligible heat losses at the exposed walls 1, 3 or the top 6). Once the plate product 15 is at a substantially homogeneous temperature T1, additional controlled heat input from induction heating device 9 is applied to side wall 4 of the plate to maintain a temperature T2 at the heated side wall 4 and cooling is applied to side wall 2 of the plate to maintain a temperature T3 at the cooled side wall 2, wherein T3 is less than T2, typically T3 is about equal to T1.

With adequate control a temperature gradient along directions a and b can be realized and maintained. For example, a temperature gradient along direction "a" from 120° C. (T3) at one side wall 2 to 165° C. (T2) at the other side wall 4 can be realized and maintained. This gives a different thermal history at different plate locations over a relatively short distance, for example of about 1 m, and corresponding variation in engineering properties.

Figure 3A:
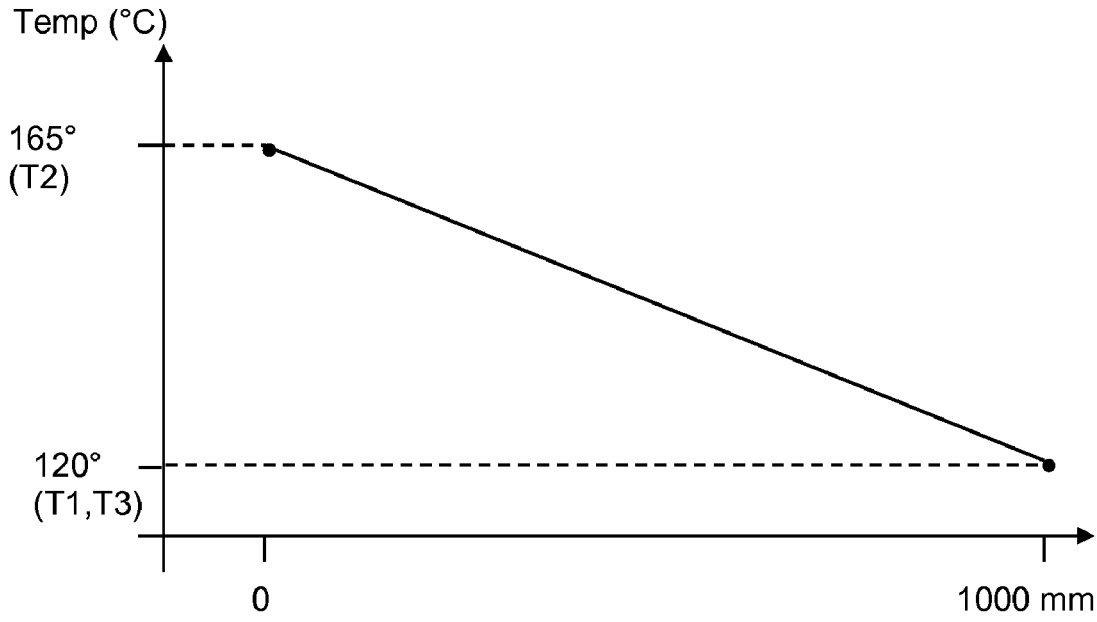
FIG. 3A is a schematic temperature profile for an aluminum alloy product achieved within an apparatus shown in FIG. 2 when T1=T3.

FIG. 3A shows a temperature profile, i.e. a temperature gradient, of a plate treated as shown in FIG. 2, wherein the plate has a temperature T2 of 165° C. at position 0 m and a temperature T3 of 120° C. at position 1 m. 0 m is the position of the heat supply 9 and 1 m is the position of the cooling device 10. In FIG. 3A, T1 is also set at about 120° C.

Figure 3B:
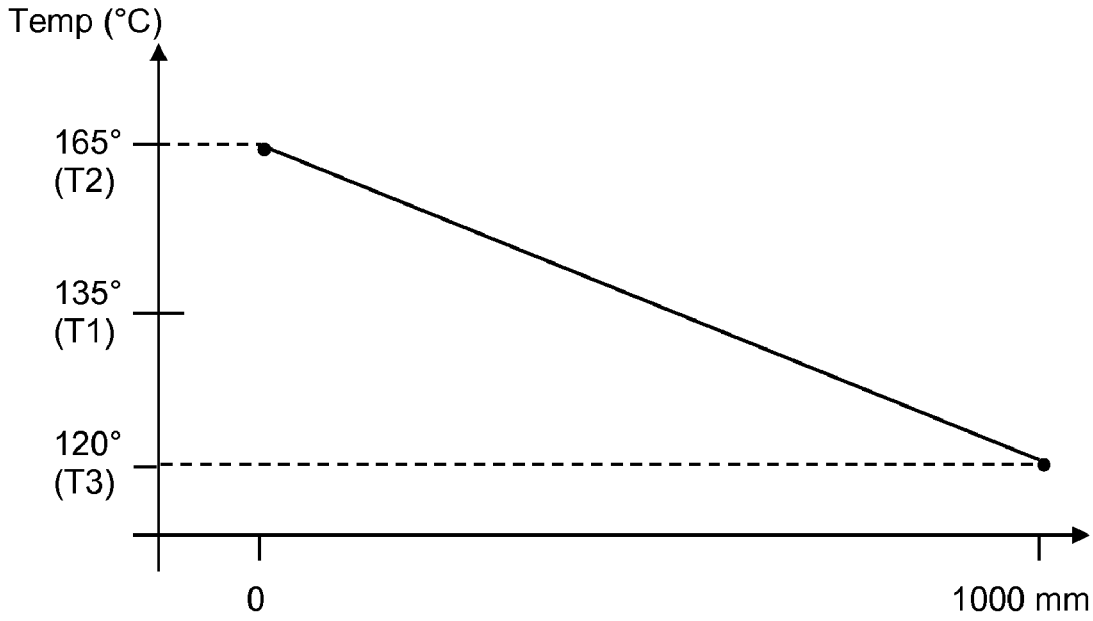
FIG. 3B is a schematic temperature profile for an aluminum alloy product achieved within an apparatus shown in FIG. 2 when T1>T3.

As shown in FIG. 3B, a schematic temperature profile for an aluminum alloy product achieved within an apparatus shown in FIG. 2 when T1>T3, the same effect (although in a different time scale) may be obtained if the base temperature T1 is set above T3, for example T1 is set at about 135° C., and T2 is set at about 165° C., and T3 is maintained at about 120° C. This may result in the same desired temperature gradient and the resultant difference in tempers at the opposed heated and cooled portions of the product being treated.

Figure 4:
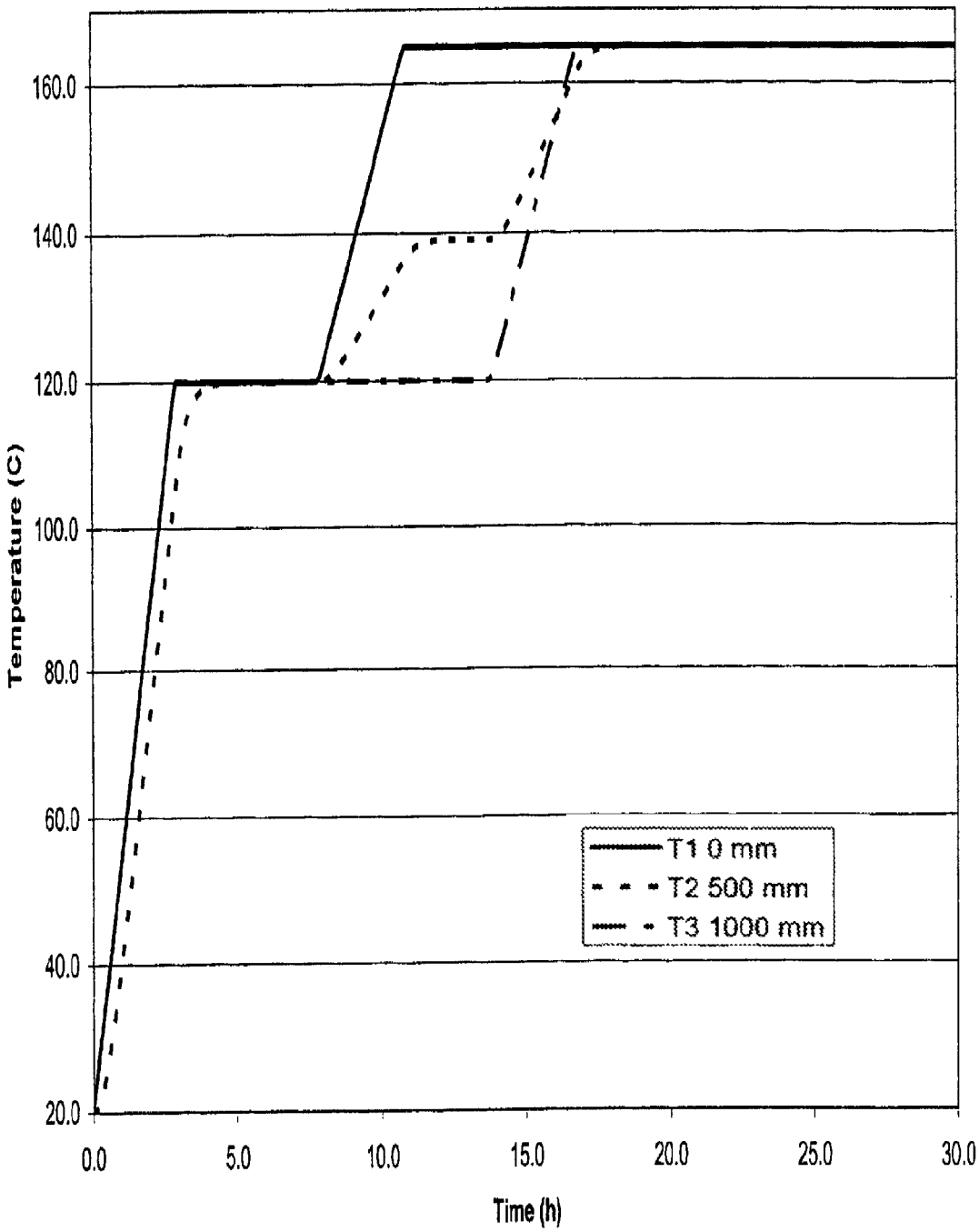
FIG. 4 is a graphical representation of the time at a temperature as predicted by numerical modelling by the example in FIG. 2.

FIG. 4 demonstrates the time evolution of the temperature at different locations in an aluminum alloy plate product. This temporal thermal gradient can be used to create a plate with tempers that represent T74 at one plate end location and T76 at the other plate end location, with a gradual corresponding change in properties. Accordingly, the apparatus of the present application is able to realize, for example, an about 45° C. temperature difference over about 1 m, i.e. a relatively short distance, of plate product width, whereby this heat treatment concept is a significant improvement over the prior art.

Figure 5A:
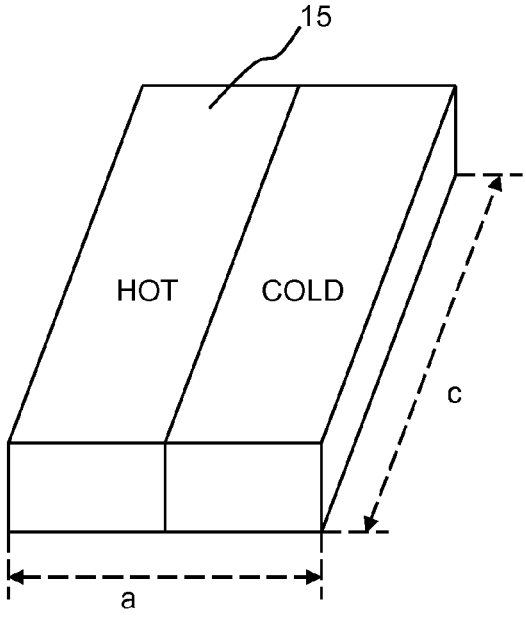
FIG. 5A is a perspective view of a plate with a linear profile along the width of the plate that received a graded heat treatment as shown in FIG. 2.

FIG. 5A shows schematically a plate 15 (with width "a" and length "c") having a linear profile, i.e., a linear temperature profile, along the width "a" of a plate after carrying out the heat treatment as shown in FIG. 2. It should be realized that from the "HOT" part of the plate to the "COLD" part of the plate there is a smooth transition, i.e. a temperature gradient. Thereby, a temperature gradient over the entire width of the plate can be achieved. In this configuration the plate product can be used, for example, for manufacturing, via machining operations or other methods, a rib member of an aircraft having a first temper at one end and a second temper at another end.

Figure 5B:
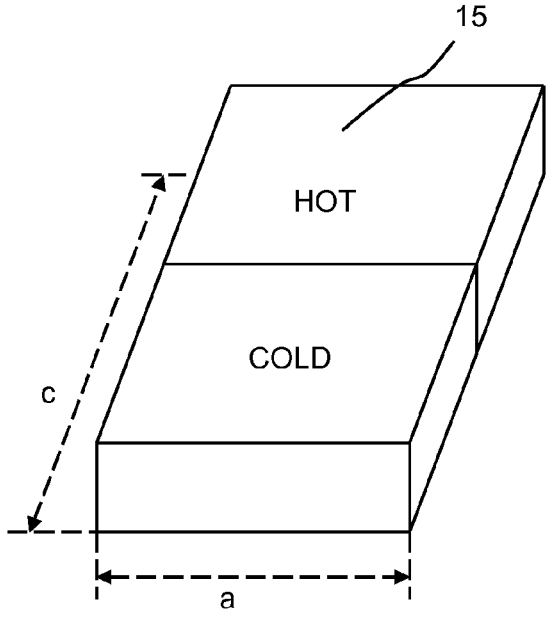
FIG. 5B is a perspective view of a plate with a linear profile along the length of the plate that received a graded heat treatment as shown in FIG. 2.

FIG. 5B shows schematically a linear profile, i.e., a temperature profile, along the length "c" of a plate 15 after carrying out the heat treatment as shown in FIG. 2 where the locations of T2 and T3 are mover to side walls 1 and 3. It should be realized that from the "HOT" part of the plate to the "COLD" part of the plate there is a smooth transition, i.e., a temperature gradient. Thus, a temperature gradient over the entire length of the plate can be achieved. In this configuration the aluminum product can be used for example for manufacturing, via machining operations or other methods, a wing skin member of an aircraft, wherein for example the wing root is at a T74 temper and the winglet is in a T76 temper.

It will be immediately clear for the skilled person that the embodiments as shown in FIGS. 5A and 5B could also be combined to obtain a plate product having gradient engineering properties in multiple directions.

Figure 6:
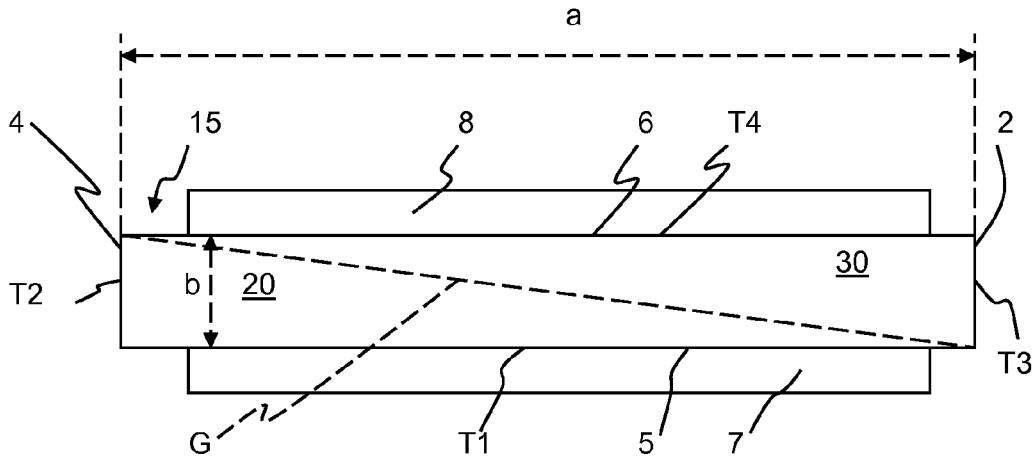
FIG. 6 schematically shows the heat gradient through a plate heated at side wall to T2, heated at a bottom wall to T1, cooled at a side wall to T3, and insulated by insulation to T1 along a top wall.

FIG. 6 schematically shows the temperature gradient G (indicated by the dashed line) through a plate 15 heated at side wall 4 to T2, heated at bottom wall 5 to T1, cooled at side wall 2 to T3, and either insulated by insulation 8 or in a variation heated by a heater (not shown) to T4 along top wall 6. In this embodiment T2 is greater than T1; T2 is greater than T3; T2 is greater than T4; and T3 and T4 are less than or about equal to T1. In the plate 15 a relatively warmer zone 20 and a relatively cooler zone 30 form. This results in a different heat history for the zones 20, 30. Typically each of zones 20, 30 are greater than about 20 or 30 wt % of the plate 15, such that a first portion of the plate 15 in the warmer zone 20 has a first temper and a second portion of the plate 15 in the cooler zone 30 has a second temper, wherein the first and second portions are each greater than 20% or 30% of the plate 15.

Figure 7:
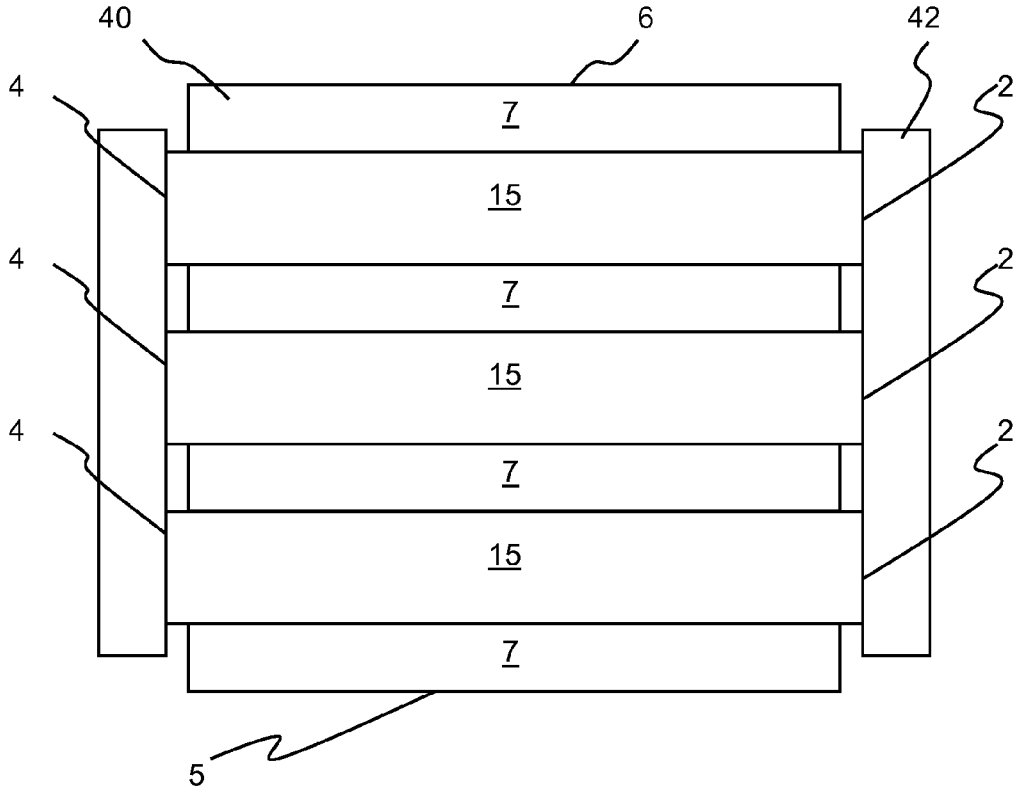
FIG. 7 shows a stack of a plurality of plates being treated.

In another embodiment, shown in FIG. 7, a stack of a plurality of plates 15 is treated. The top walls 6 and bottom walls 5 of each plate 15 are heated to a temperature T1 by a plurality of heaters 7. The side walls 4 are heated to a temperature T2 by a heater 40. The side walls 2 (opposite to side walls 4) are cooled by a cooler (heat sink) 42 at a temperature T3. In this embodiment T2 at side walls 4 is greater than T1 at top walls 6 and bottom walls 5; T2 is greater than T3; and T3 is less than or about equal to T1. Typically T2 is 20 to 80° C. greater than T1; and T2 is 20 to 80° C. greater than T3; and T1 is within 20° C. of T3.

Other embodiments are also possible.

Figure 8:
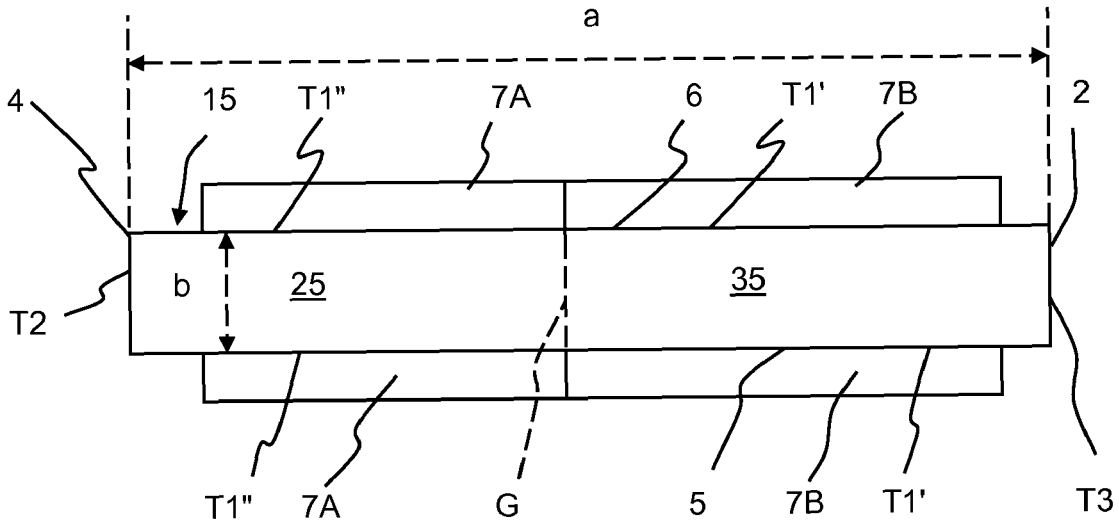
FIG. 8 shows an embodiment in which the present invention operates on an extrusion having a top wall, opposed side walls, and bottom wall.

FIG. 8 shows an embodiment having two different temperatures T1',T1" on respective portions of its upper panel 6 and two different temperatures T1', T1" on respective portions of its lower panel 5. In a further embodiment more than two different temperatures can be applied on a wall. This is accomplished by having two heaters 7A,7B operating on upper panel 6 and two heaters 7A, 7B operating on lower panel 5. T1" is greater than T1'. As in the above-described embodiments T2 is greater than T3 due to heating at panel 4 and cooling at opposed panel 2. In the plate 15 a relatively warmer zone 25 and a relatively cooler zone 35 forms with a gradient G. Typically each of zones 25, 35 are greater than about 20 wt % of the plate.

Figure 9:
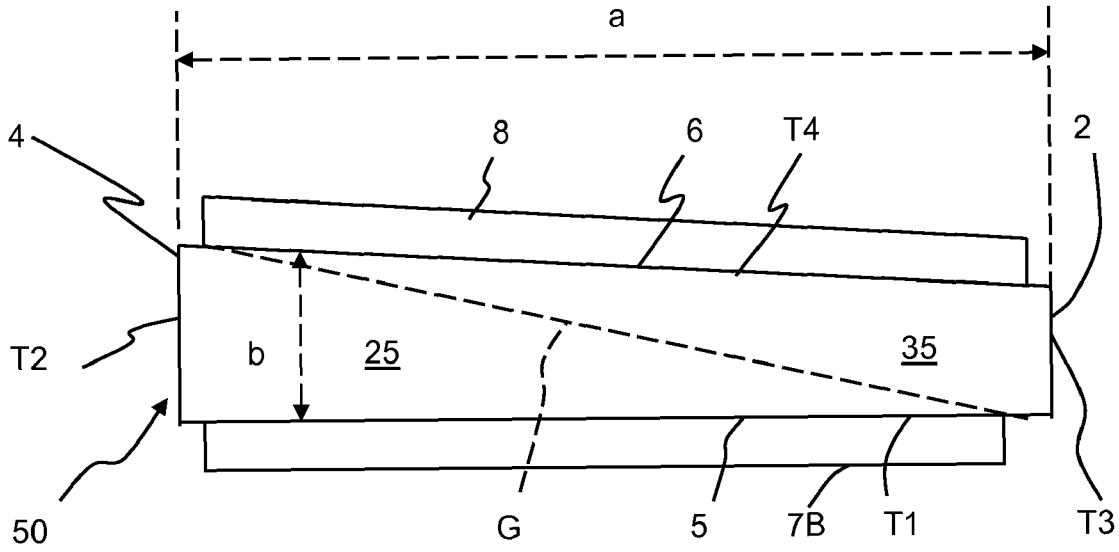
FIG. 9 shows an embodiment of an extrusion heated according to the present invention.

FIG. 9 shows an embodiment in which the present invention operates on for example an extrusion 50 having a top wall 56, opposed side walls 52, 54, and bottom wall 55. This embodiment has insulation 8 provided for the top wall 56 to achieve a temperature T4 for the top wall 56 and a heater 7 is provided for the bottom wall 55 to achieve a temperature T1 for the bottom wall 55. Also, a heater 7 is provided for the bottom wall 55 to achieve a temperature T1 at the bottom wall 55. Also, a cooler (not shown) is provided at the side wall 52 to achieve a temperature T3. T2 is greater than T1. T2 is greater than T3. T3 is less than or about equal to T1. T4 is greater than or about equal to T1. In the extruded plate 50 a relatively warmer zone 25 and a relatively cooler zone 35 forms with a gradient G. Typically each of zones 25, 35 are greater than about 20 wt % of the plate, such that a first portion of the plate 15 in the warmer zone 25 has a first temper and a second portion of the plate 15 in the cooler zone 35 has a second temper, wherein the first and second portions are each greater than 20% or 30% of the extruded plate 50.

Having now fully described the invention, it will be apparent to one of ordinary skill in the art that many changes and modifications can be made without departing from the spirit or scope of the invention as hereon described.

The invention claimed is:

1. A method for manufacturing a heat-treatable wrought metal plate product having a length, width and thickness direction, and having a gradient in engineering properties along at least one dimension of length or width direction of the plate product, comprising the steps of:

a) providing a wrought metal plate product selected from a rolled, extruded or forged product, b) subjecting the plate product to a solution heat treatment, and c) rapidly cooling the plate product, d) ageing the cooled product comprising heat treating for time to arrive at different tempers across at least one dimension in a length or width direction of the plate product, said heat treating comprising heating the plate to raise temperature of the plate to temperature T1 above ambient temperature, and applying to the heated plate a temperature gradient between temperature T2 and T3, wherein T2>T1 and T2>T3, wherein T3 is at or above ambient temperature, across at least one length or width or thickness direction of the plate by applying a controlled heat-input into the plate from one side of the plate product to temperature T2 and a controlled cooling to temperature T3 from the plate product at the opposite side of the controlled heat input, wherein the heating the plate to raise temperature of the plate to temperature T1 comprises heating a first wall of the plate to raise the temperature of the plate to temperature T1 by directly applying heat to only the first wall, and wherein, while maintaining said first wall at about temperature T1, the controlled heat-input into the plate from one side of the plate product to temperature T2 comprises heating a second wall of the plate to the temperature T2 by directly applying heat to only the second wall, and the controlled cooling to temperature T3 from the plate product at the opposite side of the controlled heat input comprises cooling a third wall of the plate opposed to the second wall by directly applying cooling to only the third wall to the temperature T3, the first wall extending between the second wall and the third wall, such temperature is controllable at the first, second and third walls of the plate, wherein a temperature gradient between T2 and T1 is in a range of 30° C. to 150° C., and wherein the product plate ages while applying the temperature gradient between T2 and T3.

2. The method according to claim 1, wherein the heat treating comprises heating the plate along its length direction to raise temperature of the plate above ambient temperature to temperature T1.

3. The method according to claim 1, wherein the heat treating comprises heating the first wall of the plate to raise the temperature of the plate to temperature T1, and, while maintaining said first wall at about temperature T1, heating the second wall of the plate to the temperature T2, cooling the third wall of the plate opposed to the second wall to the temperature T3, and maintaining a fourth wall opposed to the first wall at a temperature T4<T2.

4. The method according to claim 1, wherein the heat treating comprises heating the first wall of the plate to raise the temperature of the plate to temperature T1, and, while maintaining said first wall at about temperature T1, heating the second wall of the plate to the temperature T2, cooling the third wall of the plate opposed to the second wall to the temperature T3, and maintaining a fourth wall opposed to the first wall at a temperature T4<T1.

5. The method according to claim 1, wherein the heat treating comprises heating the first wall of the plate to raise the temperature of the plate to temperature T1, and, while maintaining said first wall at about temperature T1, heating the second wall of the plate to the temperature T2, cooling the third wall of the plate opposed to the second wall to the temperature T3, and maintaining a fourth wall opposed to the first wall at a temperature T4 about equal to T3.

6. The method according to claim 1, wherein the heat treating comprises heating the first wall of the plate to raise the temperature of the plate to temperature T1, and, while maintaining said first wall at about temperature T1, heating the second wall of the plate to the temperature T2, cooling the third wall of the plate opposed to the second wall to the temperature T3, and maintaining a fourth wall opposed to the first wall at a temperature T4 about equal to T1.

7. The method according to claim 1, wherein the controlled heat input from the at least one direction is carried out across the width direction.

8. The method according to claim 1, wherein the heat input from the at least one direction is carried across the length direction.

9. The method according to claim 1, wherein the ageing comprises artificial ageing, wherein T1 and T3 are above ambient temperature.

10. The method according to claim 1, wherein T1 is above ambient temperature and T3 is at about ambient temperature.

11. The method according to claim 1, wherein in step d) the temperature T1 is in the range of 50° C. to 220° C.

12. The method according to claim 1, wherein in step d) the temperature T1 is in the range of 50° C. to 200° C.

13. The method according to claim 1, wherein in step d) the temperature gradient (T2−T1) is in a range of 45 to 150° C.

14. The method according to claim 1, wherein in step d) the temperature gradient (T2−T1) is in a range of 45 to 80° C.

15. The method according to claim 1, wherein the wrought metal product has a gradient in engineering properties along at least two dimensions.

16. The method according to claim 1, wherein the wrought metal product is an aluminum alloy.

17. The method according to claim 1, wherein the wrought metal product is an aluminum alloy structural member of an aeronautical construction, in particular an upper wing skin, lower wing skin, wing rib, spar, or stringer.

18. The method according to claim 1, wherein the applying to the heated plate of said temperature gradient between temperature T2 and T3 is across at least one width or thickness direction of the plate.

19. The method according to claim 1, wherein:

T3 is less than or equal to T1.

20. The method according to claim 1, wherein a cooler for cooling the third wall comprises one or more heat sinks from at least one direction of the wrought metal product opposite to the direction of controlled heat-input; and wherein a first heater for said applying of heat to the first wall and a second heater for said applying of heat to the second wall are each selected from at least one member of the group consisting of a heating plate, an induction heating device, arrays of induction coils, arrays of gas burners, devices for distributing jets of hot fluid, and electrical resistors.

* * * * *